US005209188A

United States Patent [19]

Weitzel

[11] Patent Number: 5,209,188

[45] Date of Patent: May 11, 1993

[54] FLUID BED COMBUSTION REHEAT STEAM TEMPERATURE CONTROL

[75] Inventor: Paul S. Weitzel, Canal Fulton, Ohio

[73] Assignee: The Babcock & Wilcox Company, New Orleans, La.

[21] Appl. No.: 891,096

[22] Filed: Jun. 1, 1992

[51] Int. Cl.[5] ..... F22D 5/26

[52] U.S. Cl. ..... 122/451.1; 122/451 S; 122/466; 122/477

[58] Field of Search ..... 122/451.5, 466, 451.1, 122/451 R, 4 D, 477

[56] References Cited

U.S. PATENT DOCUMENTS 3,937,024 2/1976 Durrant et al. ..... 122/451 R X
4,144,846 3/1979 Miszak ..... 122/451 S X
5,056,468 10/1991 Wittchow et al. ..... 122/451 S

*Primary Examiner*—Edward G. Favors

*Attorney, Agent, or Firm*—Robert J. Edwards; Michael L. Hoelter

[57] ABSTRACT

A reheat steam temperature control system that utilizes the separate components of a reheater and a reheat heat exchanger to generate hot reheat steam. The reheater uses the fluidized bed as its source of heat while the reheat heat exchanger uses main steam as its source of heat. A bypass control valve is operated to divert the required amount of main steam to the reheat heat exchanger depending on operating conditions. Should the temperature of the hot reheat steam be too low, additional main steam is delivered to the reheat heat exchanger. Conversely, should the temperature of the hot reheat steam be too high, the amount of main steam delivered to the reheat heat exchanger is reduced. Attemperators are used within both the reheating circuit and the main steam circuit to temper the fluctuations of their respective steam.

6 Claims, 1 Drawing Sheet

TCV
MS
32
42
HRH
30
SSH
RH
40
FLUIDIZED
BED PROCESS
SHSCV
SH
ATT
26
28
50
44
12
RH HXCH
RHBCV
46
48
RH ATT
CRH
PSH2
24
36
34
38
RH SCV
PSH1
10
20
VS
22
SG3
16
SG2
SG1
FCV
14
FW
18

FLUID BED COMBUSTION REHEAT STEAM TEMPERATURE CONTROL

FIELD OF THE INVENTION

This invention pertains to the reheat steam system of fluid bed combustion plants and more particularly to a means of controlling the temperature of this system without compromising the constraints imposed by the fluid bed combustion process.

BACKGROUND OF THE INVENTION

With regard to fluid bed combustion (FBC) plants, it is desired to reheat steam in the Rankine cycle without compromising the constraints imposed by the fluid bed combustion process. This is because the constraints of the combustion process can supersede the desired features of the reheat steam system, thus attaining a less than optimum reheat cycle and a less favorable plant design.

In the past, external heat exchangers using recycled bed material have been used to supply heat to the reheat circuit. However, when the recycle energy of this bed material was not high enough, other means, such as directly utilizing the in-furnace tube surface, became necessary. Unfortunately, the low tube mass of such a reheat circuit causes problems as a result of the very high heat input of the FBC process.

Should the absorbed heat be too great, reheat spray attemperation can be used to temper the fluctuation of the reheat steam. Unfortunately, such spray attemperation is very inefficient. Furthermore, it is desired for the control range of such reheated steam to be as wide as possible under a variety of load conditions (down to about 50% load or less).

One constraint in the arrangement of a reheat circuit in a fossil fired steam generator is the fact that the pressure drop must be small. The efficiency of the Rankine steam cycle is significantly reduced if large pressure losses occur. To minimize such losses, it is common to install a large number of steam flow paths in the furnace which are short in length and which have few bend or other restriction losses. Additionally, the tube flow area or diameter must be large enough to keep the mass flow velocity low thereby reducing friction and shock loss pressure drops. Furthermore, the distribution of steam flow into each of these numerous tubes cannot be accompanied by a high flow control pressure drop. In most cases, reheat pressure is relatively low (about 600 psi) while its volume of flow is relatively large (about 90% of main steam flow).

It is thus an object of this invention to provide a reheat circuit for generating hot reheat steam whose temperature can be controlled over a wide range of operating parameters. Another object of this invention is to provide a means of reheating that separately utilizes both main steam and flue gas as a heat source. Still another object of this invention is to provide for such reheating while remaining within the constraints of the FBC process and without introducing large pressure losses. Yet another object of this invention is to provide a means for attemperation should the reheat temperature become excessive. These and other objects and advantages of this invention will become obvious upon further investigation.

SUMMARY OF THE INVENTION

This invention pertains to a reheat steam temperature control system that includes a reheating circuit for generating hot reheat steam and a main steam circuit for generating main steam. The reheating circuit is composed of a reheat heat exchanger and a reheater, with the reheater designed for a fluidized bed process as its heat source. The main steam circuit is composed of a superheater and a secondary superheater. Also incorporated within the main steam circuit is a reheater bypass control valve that diverts a portion of the generated main steam to the reheat heat exchanger which uses this main steam as its heat source. Preferably, this reheater bypass control valve is located intermediate the superheater and the secondary superheater. As a result, when the temperature of the hot reheat steam is lower than required, a portion of the main steam is diverted to the reheat heat exchanger by the reheater bypass control valve; and, when the temperature of the hot reheat steam is higher than needed, the flow of main steam to the reheat heat exchanger is reduced.

BRIEF DESCRIPTION OF THE DRAWING

Sole

DETAILED DESCRIPTION OF THE DRAWING

Figure 1:
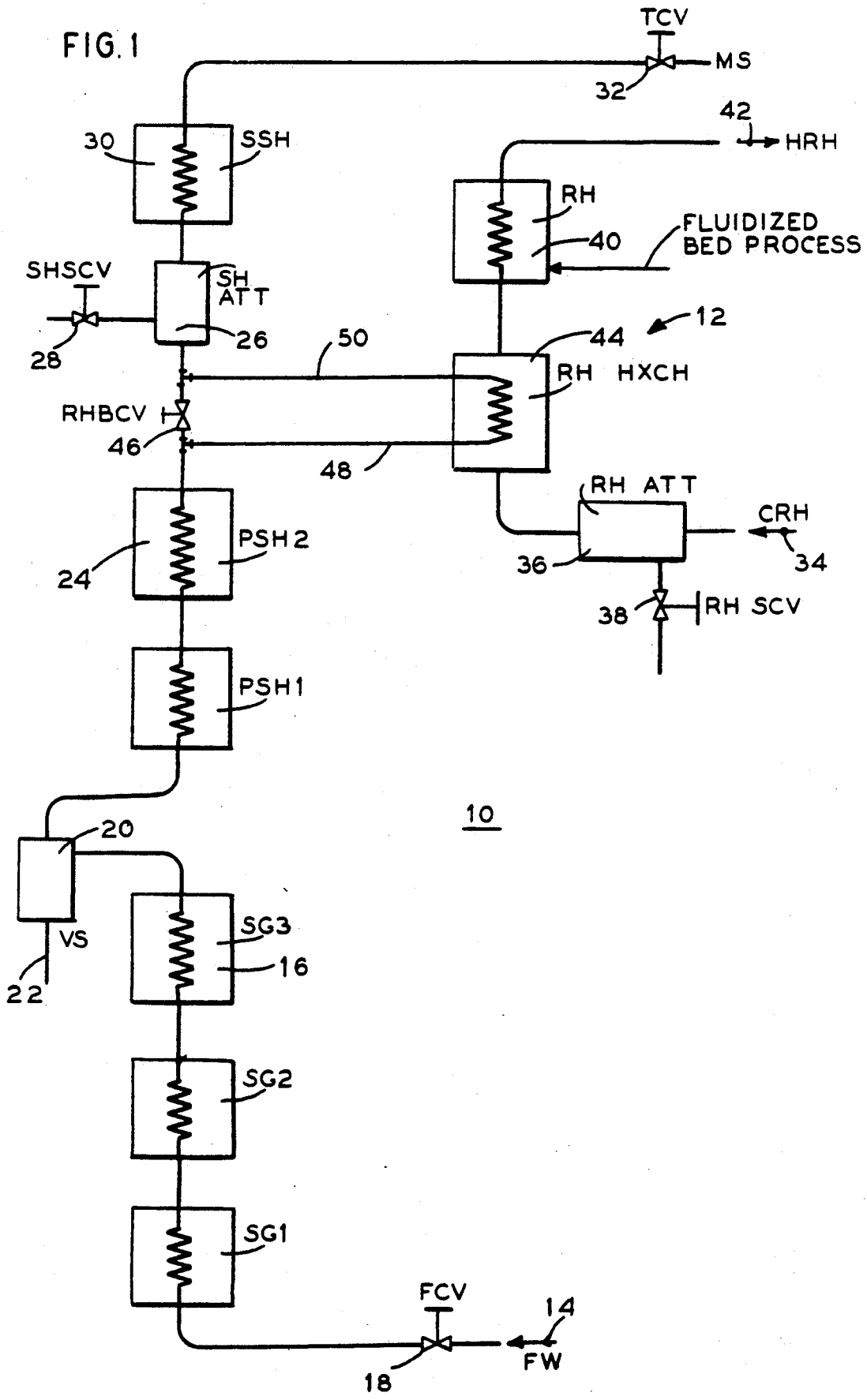
FIGURE 1 is a schematic line diagram of the invention illustrating its various components and flow paths.

Referring to the drawing, there is shown typical once through fluid bed combustion process (FBC) 10 with reheat steam temperature control system 12 incorporated therein. It should be understood, however, that such reheat control 12 can also be incorporated within drum type boilers as well.

Typical FBC process 10 originates with feedwater (FW) 14 entering steam generator tube circuits (SG1, SG2, SG3) 16 via feedwater control valve (FCV) 18. Vertical steam separator (VS) 20 is used for startup when more feedwater 14 is demanded than can be vaporized to steam. Generally, a boiler circulation pump (not shown) provides this minimum flow so that the feedwater supplied equals the steam generated thereby reducing the drain flow volume 22 from vertical steam separator 20. Oftentimes, the minimum feedwater flow provided steam generator tube circuits 16 is about 40% of normal operating flow. These circuits 16 are normally designed to be water cooled, but the outlet of SG3 may be slightly superheated.

After passing through steam generator tube circuits 16, the vapor enters superheating tube circuits (PSH1 and PSH2) 24. These circuits 24 are used to increase the superheat temperature in order to allow for proper downstream spray attemperation. Additionally, superheating circuits 24 supply additional heat for use in a downstream reheat heat exchanger.

From superheating tube circuits 24, the feedwater (now main steam) enters superheat spray attemperator (SHATT) 26 which monitors and regulates the temperature of the incoming main steam. A superheat spray control valve (SHSCV) 28 controls the amount of spray delivered to attemperator 26 thereby providing a means for adjusting the temperature of this main steam. The final main steam temperature increase is achieved in the tube circuits of secondary superheater (SSH) 30 before such main steam is delivered to turbine control valve (TCV) 32. This valve 32 controls the pressure of the main steam with full pressure or variable pressure operation being possible depending upon the need.

After the energy from the main steam is removed by the performance of work, such as by passing through a high pressure turbine (not shown), the residual steam, now cold reheat steam (CRH) 34, enters reheater spray attemperator 36. In attemperator 36, the temperature of cold reheat steam 34 is adjusted via a spray module controlled by reheat spray control valve 38. From attemperator 36, the cold reheat steam 34 is delivered to reheater 40 which utilizes a fluidized bed process (not shown) as the heat source to increase the temperature of cold reheat steam 34. Exiting reheater 40 is hot reheat steam (HRH) 42 which is also delivered downstream so that its energy may be utilized, such as by passing through a low pressure turbine (not shown).

In accordance with this invention, two components are added to this embodiment of a once-through steam generator. A reheat heat exchanger (RHHXCH) 44 and a reheat bypass control valve (RHBCV) 46. Reheat heat exchanger 44 is located in the reheat steam circuit intermediate reheat attemperator 36 and reheater 40, while reheat bypass control valve 46 is located in the main steam circuit between superheating tube circuit 24 and superheater spray attemperator 26.

As shown, valve 46 diverts a portion of the main steam to reheat exchanger 44 via hot line 48 which is returned, after such heat exchange, via cold line 50. Thus is provided a means of sequential reheating that incorporates both main steam (in reheat exchanger 44) and the fluidized bed process (in reheater 40) as the source of heat. With this process, the final hot reheat steam 42 temperature increase is achieved in the tube circuits of reheater 40. Accordingly, as cold reheat steam 34 is returned from the high pressure steam turbine exhaust, it is initially heated by reheat heat exchanger 44 using high pressure steam from the main steam flow path. The pressure of this reheat steam is determined by the expansion of the main steam through the high pressure turbine.

Should the reheat circuit (or more specifically, hot reheat steam 42), require more heat, bypass control valve 46 would be operated (closed) to force more steam to heat exchanger 44 thereby increasing the temperature of the resultant hot reheat steam 42. The subsequent reduction in temperature of the returning steam in line 50 would be compensated for by adjusting (reducing) the amount of spray through superheat spray control valve 28 for use in superheat attemperator 26. Additionally, the amount of feedwater 14 flowing into FBC process 10 would be readjusted to produce the desired outlet main steam temperature and spray attemperation flow ratio.

Alternatively, if hot reheat steam 42 is too hot, the flow through bypass control valve 46 would be increased. In this case, reheat spray attemperator 36 would be operated to reduce the temperature of this hot reheat steam 42 in short transients. It is, of course, desirable for the amount of reheat control spray to be zero thereby indicating that reheat steam temperature control system 12 is performing under optimal conditions. Thus, bypass control valve 46 is used to control the final temperature of the reheat steam. Such an ability to quickly adjust reheat absorption under a wide range of operational variations is highly desired.

Because of the introduction of reheat heat exchanger 44 that utilizes main steam as its heat source, the reheat tubes in the combustion path in reheater 40 will have less heating duty to perform. The desired large reheat temperature increase will now be accomplished by means other than solely by reheater 40. Consequently, the thermal expansion, pressure drop, and combustion process constraints can now be met since less is required of reheater 40 and, control of the reheat steam temperature can occur under much lower operating loads.

As can be imagined, when FBC process 10 is operating at maximum load, the reheat tubes in reheater 40 will absorb the maximum amount of heat. However, when the load is reduced, these tubes will consequently absorb less heat because of the reduced amount of heat available. The resulting loss in temperature absorbed by the reheat steam will be compensated for in reheat heat exchanger 44 since its source of heat is main steam, not flue gas.

It should be understood that the material selected in reheater 40 and reheat heat exchanger 44 is critical because cold reheat steam 34 must be reheated from about 600 F. to about 1,000 F. This is a wide range for any material to operate in. Thus, when the reheat tubes of typical reheater 40 are placed in a very high absorption zone, special alloy materials are required because of the temperature range demanded of them. However, by increasing the temperature of the reheat steam in two steps, the temperature range required of the material selected for each step is reduced.

Furthermore, the use of reheat spray attemperation 36 for adjusting (lowering) the temperature of hot reheat steam 42 is to be limited because it has a detrimental effect on the steam cycle efficiency. Such reheat spray should be used in instances of short-term transient temperature corrections only.

As a result of reheat steam temperature control system 12, it is now possible to achieve a desirable reheat steam cycle in a combustion process that involves some overriding constraints on reheat arrangement and placement. Additionally, a wider range of reheat steam temperature control is possible because the absorption of heat can be controlled and distributed to the proper system (i.e. reheat exchanger 44 or reheater 40). Furthermore, the "floating" evaporation end point of SG3 (which can be separately controlled) permits a very flexible control of the main steam temperature.

Some of the advantages of reheat steam temperature control system 12 include the ability for the in-process heat absorption tube circuitry of reheater 40 to be more easily suited to the combustion process constraints and limitations. For example, arrangement for erosion and corrosion protection; free flow gas path area ratio; location as to vertical placement for load turndown, etc. can now be accommodated. Second, the reheat surface need only be at the top of the fluid bed so when load turndown is accomplished, the reduction in reheat steam flow will not be too much so as to lose the ability to protect the tube materials from excessive temperature. Third, the amount of partial load reheat absorption can increase proportionately; the main steam path circuit can provide enough heat for reheating; and, the reheat circuit can be more properly located to meet the combustion process and steam circuitry constraints. Fourth, the reheat steam temperature control range can be extended. Fifth, a means for heating surface and absorption adjustments is provided. Sixth, process variations that can otherwise change the heat available for reheating can be compensated for. Seventh, the pressure drop of the reheat path can be kept small.

What is claimed is:

1. A reheat steam temperature control system for a fluidized bed boiler comprising:

(a) a reheating circuit generating hot reheat steam comprising the separate components of a reheat heat exchanger and a reheater, said reheater having the fluidized bed process as its heat source;

(b) a main steam circuit generating main steam comprising the separate components of a superheater and a secondary superheater;

(c) reheater bypass control valve means in said main steam circuit for diverting a portion of said main steam to said reheat heat exchanger and for returning said portion from said reheat heat exchanger, said reheater bypass control valve means being located intermediate said superheater and said secondary superheater;

(d) means for diverting a portion of said main steam to said reheat heat exchanger when the temperature of said hot reheat steam is lower than required, and, (e) for reducing the flow of aid main steam to said reheat heat exchanger when the temperature of said hot reheat steam is higher than needed.

2. The reheat steam temperature control system as set forth in claim 1 further comprising a reheat attemperator in said reheating circuit and a superheater attemperator in said main steam circuit, whereby, when the temperature of said hot reheat steam is lower that required, said superheater attemperator adjusts to the return of said main steam from said reheat heat exchanger and wherein when the temperature of said hot reheat steam is higher than needed, said reheat attemperator is operated to temper the flow of reheat steam through said reheating circuit.

3. The reheat steam temperature control system as set forth in claim 2 wherein said superheater attemperator and said reheat attemperator are both spray attemperators.

4. The reheat steam temperature control system as set forth in claim 3 further comprising superheater spray control valve means for controlling the spray within said superheater attemperator, and further comprising reheater spray control valve means for controlling the spray within said reheater attemperator.

5. The reheat steam temperature control system as set forth in claim 4 wherein said reheat heat exchanger is located intermediate said reheat attemperator and said reheater.

6. The reheat steam temperature control system as set forth in claim 5 wherein said reheating bypass control valve means is located intermediate said superheater and said superheater attemperator.

* * * * *